US006719455B2

(12) United States Patent
Ecoffet

(10) Patent No.: US 6,719,455 B2
(45) Date of Patent: Apr. 13, 2004

(54) METHOD FOR FIXING A CROWN SCREWED ON A WATCH CASE AND WATCH CASE EQUIPPED WITH SAME

(75) Inventor: Roger Ecoffet, Villers-le-Lac (FR)

(73) Assignee: KS 22 SA (CH)

( * ) Notice: Subject to any disclaimer, the term of this patent is extended or adjusted under 35 U.S.C. 154(b) by 119 days.

(21) Appl. No.: 10/009,241

(22) PCT Filed: Dec. 1, 2000

(86) PCT No.: PCT/EP00/12304

§ 371 (c)(1),
(2), (4) Date: Dec. 7, 2001

(87) PCT Pub. No.: WO01/40881

PCT Pub. Date: Jun. 7, 2001

(65) Prior Publication Data

US 2003/0007426 A1 Jan. 9, 2003

(30) Foreign Application Priority Data

Dec. 2, 1999 (CH) ..... 2204/99

(51) Int. Cl.[7] ..... G04B 29/00; G04B 37/00
(52) U.S. Cl. ..... 368/319; 368/286; 368/288
(58) Field of Search ..... 368/286, 288, 368/319

(56) References Cited

U.S. PATENT DOCUMENTS 4,979,156 A * 12/1990 Kester ..... 368/289
5,184,334 A * 2/1993 Vollert ..... 368/319
5,521,890 A * 5/1996 Miche et al. ..... 368/319
6,315,443 B1 * 11/2001 Meyrat et al. ..... 368/290

FOREIGN PATENT DOCUMENTS

CH 347136 7/1960
DE 003313515 A1 * 10/1984 ..... 368/184
JP 355076969 A * 6/1980 ..... 368/319

* cited by examiner

*Primary Examiner*—David Martin
*Assistant Examiner*—Michael L. Lindinger
(74) *Attorney, Agent, or Firm*—Baker Botts L.L.P.

(57) ABSTRACT

The invention concerns a method for assembling a screwed crown on a watch case, characterized in that it includes the following steps:

Figure 2:
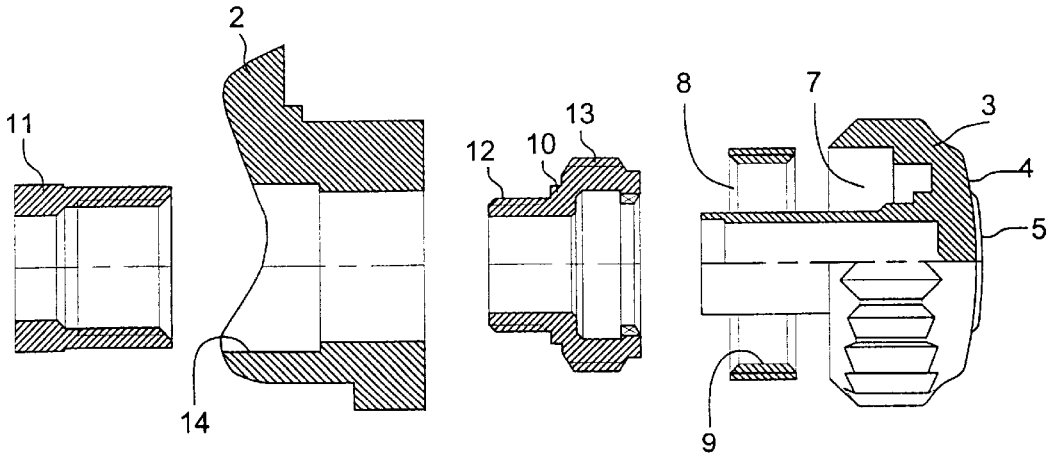

providing a crown with an inner threading the position of which is set with respect to the logo arranged on the front face of the crown;

providing an intermediate tube including two threaded sections;

mounting said intermediate tube in a smooth through hole passing through the case and wedging it on an assembling jig to arrange the thread start of the tube intended to accommodate the internal screw thread of the crown in an angular position such that when the crown is screwed as far as possible onto the tube said logo or said mark is located in a determined position;

providing a nut and immobilizing the tube in said angular position.

6 Claims, 1 Drawing Sheet

METHOD FOR FIXING A CROWN SCREWED ON A WATCH CASE AND WATCH CASE EQUIPPED WITH SAME

This application is a national phase application of international application Serial No. PCT/EP00/12304 filed Dec. 1, 2000 and published in French on Jun. 7, 2001 as WO 01/40881 A1, which itself claims priority to Swiss patent application No. 2204/99 filed on Dec 2, 1999.

The present invention concerns a method for assembling a screwed crown, such as a winding crown, onto a watch case.

More particularly, the invention concerns an assembly method of this type allowing the position of a screwed crown on a watch case to be set with respect with a pointer on the face of a watch case so that a logo placed on the front of said crown can always be easily brought into a determined position or orientation after having been unscrewed.

The invention also concerns a watch case provided with a screwed crown including a logo wherein the logo is oriented in a determined manner.

The manufacture and assembly of screwed crowns onto watch cases are well known. However, the assembly methods for these crowns have an important drawback. Known assembly methods do not allow one to ensure that the crown has been brought into a determined orientation with respect to the case after having been unscrewed, which is detrimental to the aesthetic appearance of the case when a mark or logo is affixed to a face of the crown. This situation is of course unacceptable when such crowns are fitted to luxury and high quality products.

The main object of the present invention is to overcome the drawbacks of the aforementioned prior art by providing a simple and economical method for assembling a crown including a logo or a mark which systematically allows the crown to be screwed back into a determined position or orientation after having been unscrewed.

The invention therefore concerns a method for assembling a screwed crown on a watch case, characterised in that it includes the following steps:

- providing a crown with an inner threading the position of which is set with respect to the logo arranged on the front face of the crown;
- providing an intermediate tube including two threaded sections;
- mounting said intermediate tube in a smooth through hole of the case and wedging it on an assembling jig to arranged the thread start of the tube intended to accommodate the internal screw thread of the crown in an angular position such that when the crown is screwed as far as possible onto the tube said logo is located in a determined position;
- providing a nut and immobilising the tube in said angular position.

According to an advantageous feature of the invention, the manufacture of the crown with the angularly set internal screw thread includes the following steps:

- providing a threaded ring;
- positioning said ring using an assembling jig so as to set the position of said internal screw thread with respect to the logo or the mark borne by the face of said crown; and
- immobilising said ring on said crown in said set position.

The invention also concerns a watch case including a screwed crown provided with an internal screw thread, the front face of said crown including a logo or a mark, an intermediate tube including a threaded external section intended for accommodating said internal screw thread, said intermediate tube being fixedly mounted in the case, the latter being characterised in that the position of the internal screw thread of the crown is set with respect to the logo or the mark and in that the intermediate tube is mounted in the case in order to be able to be oriented angularly with respect to the case and fixed on the case in a determined angular position.

According to an advantageous feature, on the side opposite said front face the crown includes an annular groove in which a ring provided with an internal screw thread is fixedly mounted. According to another feature, the ring is welded to the crown.

According to another feature, the intermediate tube is mounted in a smooth hole arranged in the case and is secured to the case by means of a nut.

Figure 1:
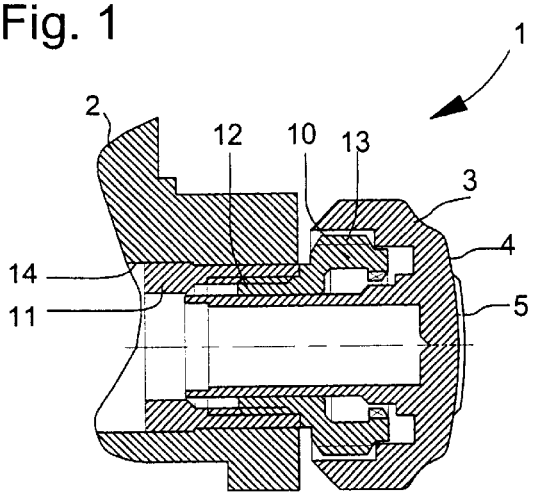

Other features and advantages of the present invention will appear in the following description of a preferred embodiment, given by way of non limiting example with reference to the annexed drawings, in which:

FIG. 1 shows a cross-section of the crown assembled in accordance with the method of the invention; and FIG. 2 shows an exploded view of the crown prior to implementation of the method of the invention.

The method for assembling a screwed crown 1 onto a watch case 2 which is only partially shown in the drawing, will be described hereinafter in conjunction with FIGS. 1 and 2. Screwed crown 1 includes a first portion formed of a head 3 having a front face 4 onto which is affixed a logo or a mark 5 which, in the screwed in position of said crown, has a determined angular orientation with respect to case 2. This first portion is connected to the movement in a conventional manner. On the opposite side to frontal face 4, head 3 is provided with an annular groove 7 which accommodates a ring 8 with an internal screw thread 9. Ring 8 is positioned in groove 7 by using an assembling jig (not shown) so as to set the position of said internal screw thread 9 with respect to logo 5 and it is immobilised in groove 7 in said angularly set position. The position setting operation is preferably carried out using a camera and the immobilising operation by a welding operation for example laser welding. Logo 5 consequently has a determined and known angular position with respect to the start of internal screw thread 9. The crown further includes a second portion connected to case 2. This second portion includes an intermediate tube 10 and a nut 11 intended to immobilise tube 10 in a determined angular position on case 2. Tube 10 includes two externally threaded sections 12 and 13 which co-operate respectively with nut 11 and angularly set internal screw thread 9. According to the method of the invention, tube 10 is freely mounted in a smooth through hole 14 of the case. Tube 10 is then wedged using an assembling jig (not shown) to arrange the start of threading 13 in an angular position such that when crown 1 is screwed as far as possible onto tube 10 said logo 5 is located in a determined angular position with respect to the case. Once this wedging operation has been completed, tube 10 is immobilised by nut 11.

It will be noted that the crown may already be screwed as far as possible onto tube 10 when it is positioned, the setting then being achieved not on the start of threading 13 but directly on the orientation of the logo before wedging tube 10 using nut 11.

What is claimed is:

1. Method for assembling a screwed crown on a watch case, characterised in that it includes the following steps:

- providing a crown with an inner threading the position of which is set with respect to a logo or a mark arranged on the front face of the crown;
- providing an intermediate tube including two threaded sections;
- mounting said intermediate tube in a smooth through hole of the case and wedging it on an assembling jig to arrange the thread start of the tube intended to accommodate the internal screw thread of the crown in an angular position such that when the crown is screwed as far as possible onto the tube said logo is located in a determined position;

providing a nut and immobilising the tube in said angular position.

2. Assembly method according to claim 1, characterised in that manufacture of the crown with the indexed internal screw thread includes the following steps:

providing a threaded ring;

positioning said ring using an assembling jig so as to set the position of said internal screw thread with respect to a logo or a mark borne by the face of said crown; and immobilising said ring on said crown in said angularly set position.

3. Watch case including:

a screwed crown provided with an internal screw thread, the front face of said crown including a logo or a mark, an intermediate tube including an external threaded section intended for accommodating said internal screw thread, said intermediate tube being fixedly mounted in said case, characterized in that the position of the internal screw thread of the crown is set with respect to the logo or mark and in that the intermediate tube is mounted in the case in order to be able to be oriented angularly with respect to the case and fixed on the case in a determined angular position.

4. Watch case according to claim 3, characterised in that on the side opposite said front face the crown includes an annular groove in which a ring provided with said internal screw thread is fixedly mounted.

5. Watch case according to claim 4, characterised in that said ring is welded to said crown.

6. Watch case according to any of claims 3 to 5, characterised in that said intermediate tube is mounted in a smooth hole arranged in said case and in that it is secured to said case in its determined angular position by means of a nut.

* * * * *